US012617597B2

(12) United States Patent
Yoshida et al.

(10) Patent No.: US 12,617,597 B2
(45) Date of Patent: May 5, 2026

(54) FILM-PACKAGED TISSUE PRODUCT COLLECTIVE PACK AND PACKAGING MATERIAL FOR FILM-PACKAGED TISSUE PRODUCT COLLECTIVE PACK

(71) Applicant: Daio Paper Corporation, Ehime (JP)

(72) Inventors: Shohei Yoshida, Shizuoka (JP); Yasutaka Okouchi, Ehime (JP); Tatsuya Minami, Ehime (JP)

(73) Assignee: Daio Paper Corporation, Ehime (JP)

( * ) Notice: Subject to any disclaimer, the term of this patent is extended or adjusted under 35 U.S.C. 154(b) by 211 days.

(21) Appl. No.: 18/250,398

(22) PCT Filed: Oct. 29, 2021

(86) PCT No.: PCT/JP2021/039996
§ 371 (c)(1),
(2) Date: Apr. 25, 2023

(87) PCT Pub. No.: WO2022/092259
PCT Pub. Date: May 5, 2022

(65) Prior Publication Data

US 2024/0017898 A1 Jan. 18, 2024

(30) Foreign Application Priority Data

Oct. 30, 2020 (JP) ..... 2020-182391

(51) Int. Cl.
*B65D 77/04* (2006.01)
*B65D 75/14* (2006.01)
(Continued)

(52) U.S. Cl.
CPC ..... *B65D 77/04* (2013.01); *B65D 75/14* (2013.01); *B65D 75/563* (2013.01); *B65D 77/12* (2013.01);
(Continued)

(58) Field of Classification Search
CPC ..... B65D 77/04; B65D 75/14; B65D 75/563; B65D 77/12; B65D 85/62;
(Continued)

(56) References Cited

U.S. PATENT DOCUMENTS

2019/0191940 A1* 6/2019 Ishikawa ..... B65B 5/06

FOREIGN PATENT DOCUMENTS

JP 2016028161 A * 2/2016
JP 2018-058600 A 4/2018
(Continued)

OTHER PUBLICATIONS

[NPL-1] Takahashi et al. (JP 2016-028161 A); Feb. 25, 2016 (European Patent Office machine translation to English). (Year: 2016).*

*Primary Examiner* — Donald M Flores, Jr.
(74) *Attorney, Agent, or Firm* — Renner, Kenner; Arthur M. Reginelli

(57) ABSTRACT

Provided is a film-packaged tissue product collective pack containing a plurality of film-packaged tissue products gusset-packaged with an exterior film into a collective pack having a handle on its top face side, wherein the exterior film is a biomass film containing 10 mass % or less biomass raw material, has a degree of blocking of 120 mN or lower, and has a tensile elastic modulus in a TD direction of 380 to 460 MPa. The collective pack may be handled and manufactured in the same way as conventional collective packs, while reduction of environmental burden may be aimed through the use of biomass raw materials.

14 Claims, 7 Drawing Sheets

(51) Int. Cl.
*B65D 75/56* (2006.01)
*B65D 77/12* (2006.01)
*B65D 85/62* (2006.01)

(52) U.S. Cl.
CPC ..... *B65D 85/62* (2013.01); *B65D 2577/043* (2013.01); *Y10T 428/1307* (2015.01); *Y10T 428/24273* (2015.01)

(58) Field of Classification Search
CPC ..... B65D 2577/043; Y10T 428/1307; Y10T 428/24273; Y02W 90/10
See application file for complete search history.

(56) References Cited

FOREIGN PATENT DOCUMENTS

| | | | |
|---|---|---|---|
| JP | 2018-058654 | A | 4/2018 |
| JP | 6721773 | B | 7/2020 |

* cited by examiner

FILM-PACKAGED TISSUE PRODUCT COLLECTIVE PACK AND PACKAGING MATERIAL FOR FILM-PACKAGED TISSUE PRODUCT COLLECTIVE PACK

FIELD OF ART

The present invention relates to a film-packaged tissue product collective pack, in which a plurality of film-packaged tissue products are packaged by gusset-packaging, each of the film-packaged tissue products being a bundle of interfolded and stacked tissues packaged with a flexible packaging film, as well as to a packaging material for such film-packaged tissue product collective pack.

BACKGROUND ART

There is known a package of tissues, which is a bundle of tissues packaged with a flexible packaging film made of resin, also referred to as a film-packaged tissue product. As such a film-packaged tissue product, portable products, referred to as pocket tissues, are popular, while some others are used in place, like so-called box tissues, which are a bundle of tissues enclosed in a paper-made storage box called a carton (referred to sometimes as a boxed product hereinbelow), or used as a refill of a bundle in a boxed product.

Film-packaged tissue products used in this way are, like boxed products, often sold in the form of a collective pack, which is a pack of a plurality of the tissue products, such as five or three of them, packaged with an exterior film. A collective pack of the film-packaged tissue products for use in place takes substantial space, and is thus commonly packaged by gusset-packaging with a handle for portability.

Conventionally, exterior films used in collective packaging are made of petroleum-derived general purpose resins, such as polyethylene and polypropylene, for their low cost. Recently, however, problems are attracting attention, such as global escalation in raw material cost of fossil fuel or environmental pollution by plastics flowing out to the ocean, and manufacturers and users are demanded to select ecological materials and products advertising "containing biomass raw materials" or "biodegradable", from various film materials.

PRIOR ART PUBLICATION

Patent Publication

Patent Publication 1: JP 2018-058600 A
Patent Publication 2: JP 2018-058654 A
Patent Publication 3: JP 6721773 B

SUMMARY OF THE INVENTION

Problems to be Solved by the Invention

It is known, however, that plant-derived polyethylene, which is a biomass raw material, contains a trace amount of impurities, and thus is hard to have properties comparable to those of petroleum-derived polyethylene, even if the two are categorized in the same grade. Researches by the present inventors have revealed that, when plant-derived polyethylene is simply used as a substitutional material for the exterior film in the manufacture of the collective packs, problems arise, such as degradation of operational efficiency during gazette packaging due to higher sealing temperatures, inadequate formation of openings in gusset-packaging tubes due to higher degrees of blocking, and deterioration of colors due to higher haze values.

It is therefore an object of the present invention to provide a film-packaged tissue product collective pack which may be handled in the same way as the conventional collective packs, and which may be manufactured with the same operational efficiency as the conventional collective packs, while reduction of environmental burden is aimed through the use of biomass raw materials, as well as a packaging material for such film-packaged tissue product collective pack.

Means for Solving the Problem

Means for solving the above problems are as follows.

The first means is a film-packaged tissue product collective pack including a plurality of film-packaged tissue products, and an exterior film gusset-packaging the plurality of film-packaged tissue products to form a collective pack having a handle on its upper side, wherein the exterior film is a biomass film containing 10 mass % or less biomass raw material, has a degree of blocking of 120 mN or lower, and has a tensile elastic modulus in a transverse direction (TD) of 380 to 460 MPa.

The second means is the film-packaged tissue product collective pack according to the first means, wherein the exterior film has a haze value of 12% or lower.

The third means is the film-packaged tissue product collective pack according to the first or second means, wherein the exterior film is a linear low-density polyethylene film containing 3 to 10 mass % plant-derived polyethylene.

The fourth means is a packaging material for a film-packaged tissue product collective pack for packaging by gusset-packaging a plurality of film-packaged tissue products into a collective pack having a handle on its upper side, wherein the packaging material is a biomass film containing 10 mass % or less biomass raw material, has a degree of blocking of 120 mN or lower, and has a tensile elastic modulus in a transverse direction (TD) of 380 to 460 MPa.

The fifth means is the packaging material for a film-packaged tissue product collective pack according to the fourth means, wherein the packaging material has a haze value of 12% or lower.

The sixth means is the packaging material for a film-packaged tissue product collective pack according to the fourth or fifth means, wherein the packaging material is a linear low-density polyethylene film containing 3 to 10 mass % plant-derived polyethylene.

Effect of the Invention

According to the present invention, a film-packaged tissue product collective pack and a packaging material for such film-packaged tissue product collective pack are provided, which may be handled in the same way as the conventional collective packs, and which may be manufactured with the same operational efficiency as the conventional collective packs, while reduction of environmental burden is aimed through the use of biomass raw materials.

MEANS FOR CARRYING OUT THE PRESENT INVENTION

The present invention will now be explained hereinbelow with reference to the embodiments shown in FIGS. 1 to 7. The packaging material for the film-packaged tissue product collective pack according to the present invention will be discussed in good time in the discussion of embodiments of the film-packaged tissue product collective pack.

Figure 1:
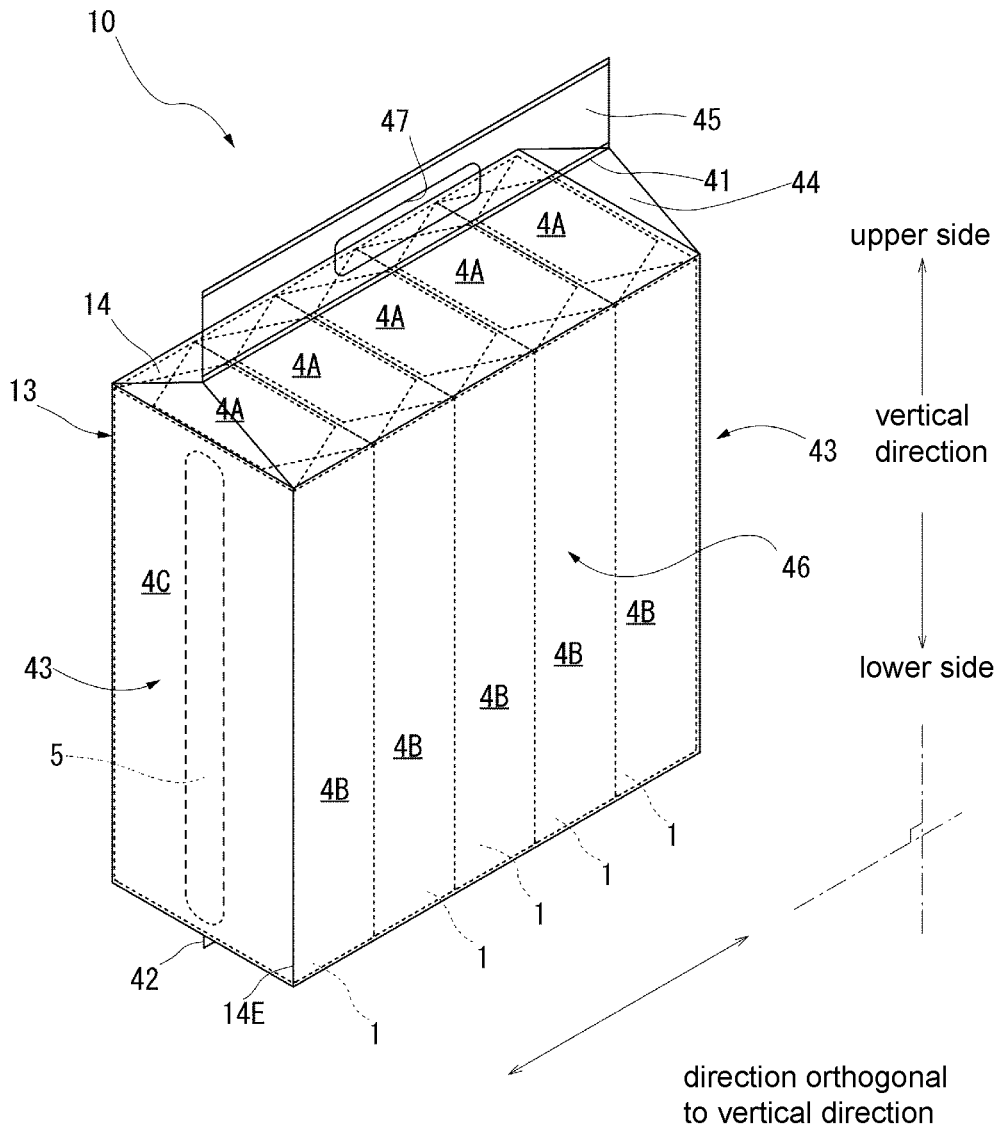
FIG. 1 is a perspective view of a film-packaged tissue product collective pack according to the present invention.

In the film-packaged tissue product collective pack according to the present invention (referred to also as the collective pack hereinbelow), as shown in FIG. 1, a plurality of film-packaged tissue products 1 are arranged and packaged by gusset-packaging with an exterior film 14 into a collective pack having a handle 45 on its upper side, each of the film-packaged tissue products 1 being a bundle 3 of interfolded and stacked tissues packaged with a flexible packaging film 4. In the collective pack 10 as shown in the drawings, a plurality of the film-packaged tissue products 1 are packaged by gusset-packaging with an exterior film 14, with the opposed end faces 4A of each product 1 oriented toward the upper side having the handle 45 and toward the lower side opposite from the upper side of the pack, and with the longitudinal direction of each product 1 aligned to the vertical (upper-lower) direction of the pack.

In this embodiment, the number of products 1 arranged in the direction orthogonal to the vertical direction of the collective pack 10 is not particularly limited, and may be six or less. Further, in the illustrated embodiment, the products 1 are arranged in one tier in the vertical direction, but may be arranged in two tiers. In addition, though not shown, the film-packaged tissue products 1 may be packaged with the exterior film 14 with the top face 4C of each product 1 oriented toward the upper side of the pack having the handle 45 and with the bottom face of each product 1 oriented toward the lower side of the pack opposite from the upper side. In this case, the products 1 may be arranged in one column and six tiers or less.

Figure 2:
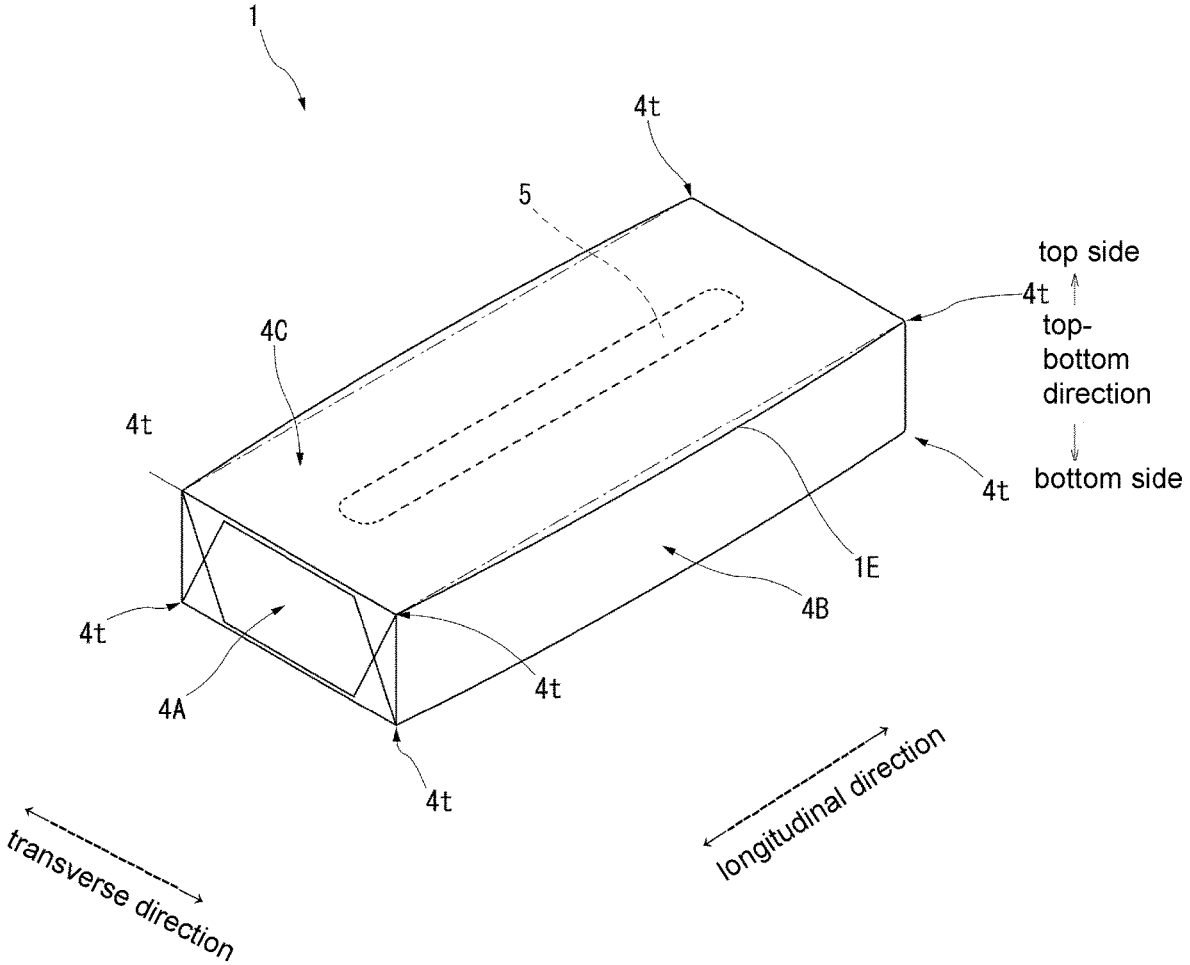
FIG. 2 is a perspective view of a film-packaged tissue product of the present invention for explanation.
Figure 3:
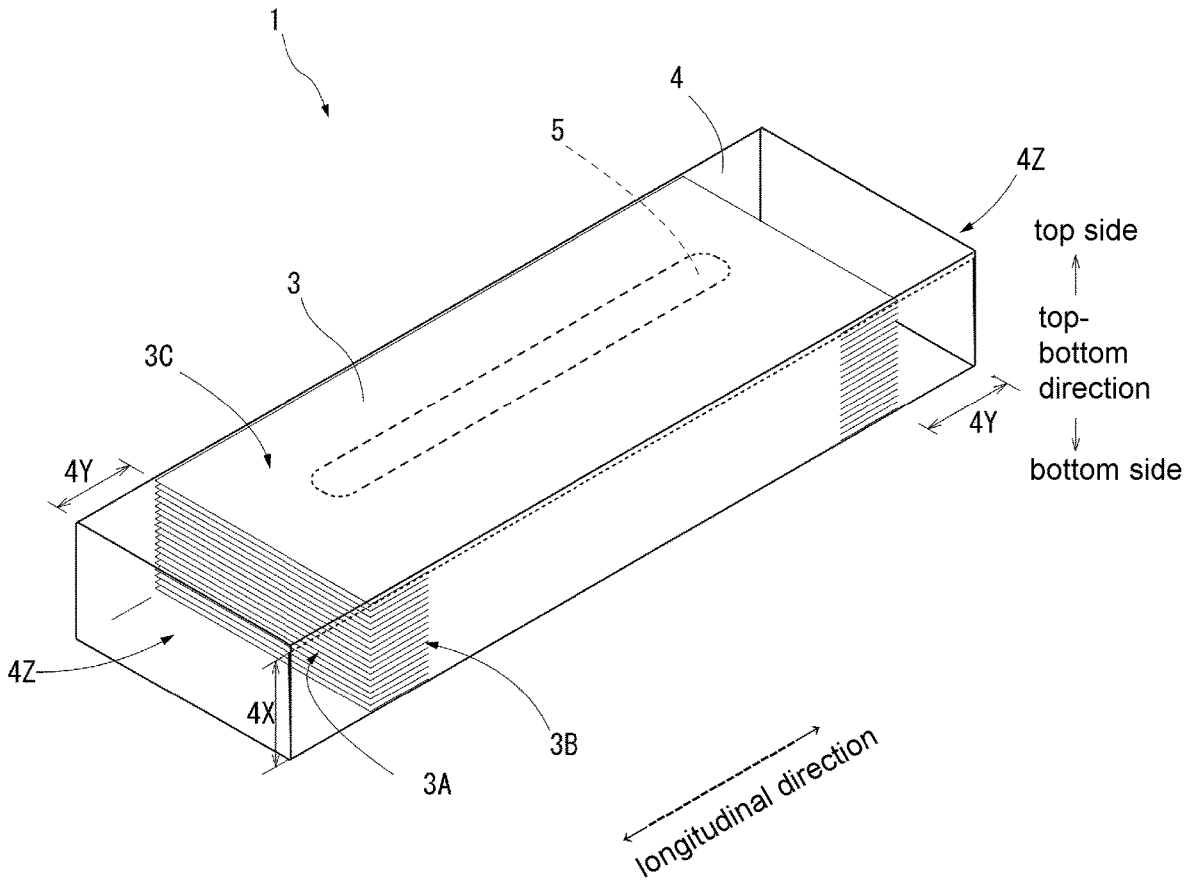
FIG. 3 is a perspective view for explaining an example of the structure of the film-packaged tissue product of the present invention.

Each of the film-packaged tissue products 1 enclosed in the exterior film 14 is, for example, a pop-up type bundle 3 of tissues packaged by pillow wrapping or overlap wrapping and, as shown in FIG. 2, is in the form of an approximate hexahedron having a top face 4C with a perforated line for tear-opening 5 defining a dispenser-hole-forming area, a bottom face opposed to the top face 4C, and end faces 4A and longitudinal lateral faces 4B located between the top face 4C and the bottom face. The overlap wrapping is a mode of wrapping, also referred to as caramel wrapping or overlaid wrapping, according to which, as shown in FIG. 3, a packaging film 4 is rolled around and wrapped cylindrically around the bundle 3, which is an article to be wrapped, so that an opening 4Z is formed at each longitudinal end, the area 4X of the packaging film overlapped in the rolling direction is adhered by heat sealing or with an adhesive, each portion 4Y extending beyond the bundle 3 is folded along near the opposed two edges of each end face of the bundle 3 onto this end face, and the resulting approximate triangular or trapezoidal pieces are overlapped at least in their respective free edge portions, and adhered by heat sealing or with an adhesive, to thereby close each opening 4Z of the cylinder into an end face 4A. According to the overlap wrapping, the end face 4A is formed with a plurality of layers of the packaging film 4 stacked and bonded together to have a high stiffness, which advantageously makes the approximate hexahedron hard to collapse and likely to maintain its shape. Note that the flexible resin packaging film 4 which forms the exterior of the film-packaged tissue product 1 is not particularly limited, and may be a commonly known packaging film.

The bundle 3 in the film-packaged tissue product 1 is a pop-up type bundle of 100 to 240 sheets of tissues, each sheet being composed of a plurality of plies. The size of the bundle 3 is not necessarily limited, and the bundle 3 may roughly have a height of 40 to 50 mm by a longitudinal dimension (width) of 160 to 200 mm by a transverse dimension (depth) of 90 to 110 mm, when 150 sheets of 2-ply tissues are bundled. Note that, as indicated by such dimensions, the film-packaged tissue product 1 according to the present invention is not a portable product, such as so-called pocket tissues, in which about 10 to 12 sheets of tissues are enclosed in a height of about 10 mm.

Each sheet of tissues constituting the bundle 3 has a ply structure in which two or three plies of crepe tissue paper are stacked to form a sheet, and the tissue paper herein is dry, i.e., is of a dry type, rather than a so-called wet type impregnated with liquid chemical. Among dry type tissues, some are of liquid-chemical-applied type, which has liquid chemical, such as a moisturizer, typically glycerin, applied thereto to increase moisture content through moisture absorption with polyols or the like, and the present tissues may be of this type.

On the other hand, the gusset-packaging according to the present invention, as shown in FIG. 1, is a mode of wrapping according to which articles to be wrapped are enclosed in a bag-shaped space located between the adhered portions 41, 42 formed by heat sealing or the like on the upper and lower sides thereof, in particular, gussets 43, 43 are formed between the front face 46 and the back face 46. In this gusset-packaging, the exterior film 14 is rendered to have a shape having gussets 43, 43 formed by unfolding folded and flattened side faces 40E, 40E, and faces contiguous to the gussets 43, 43. Contiguous to the gussets 43, 43 are the front face 46 and the back face 46, which are relatively termed, and either face without limitation may be referred to as a front face.

The handle 45 is formed, for improving portability of the collective pack 10, as an extension located on the upper side of the upper sealed portion 41, which borders on the upper side of the bag section enclosing the film-packaged tissue products 1. In the illustrated embodiment, one finger hole 47 is formed. With the finger hole 47 formed in the handle 45, portability of the collective pack is still more enhanced. Two or more finger holes 47 may be formed. The shape of each finger hole 47 is not particularly limited.

Figure 4:
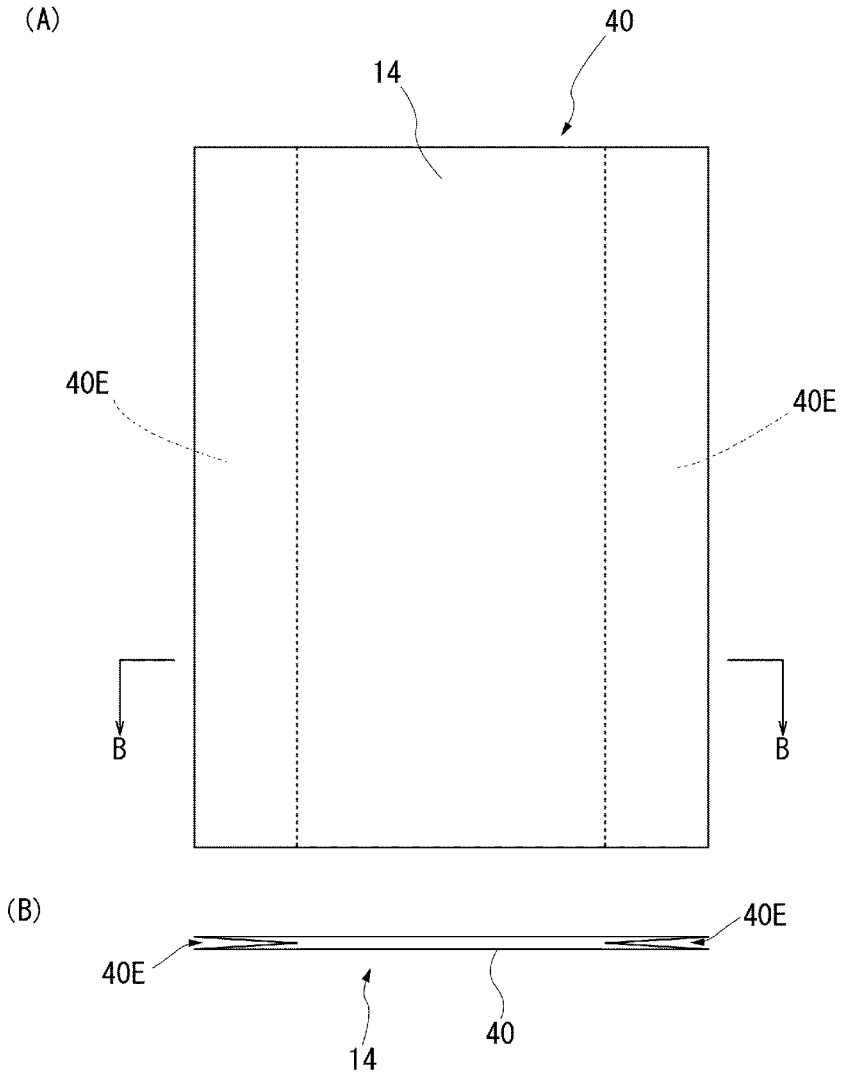
FIG. 4 is a view for explaining a packaging material for a film-packaged tissue product collective pack according to the present invention.
Figure 5:
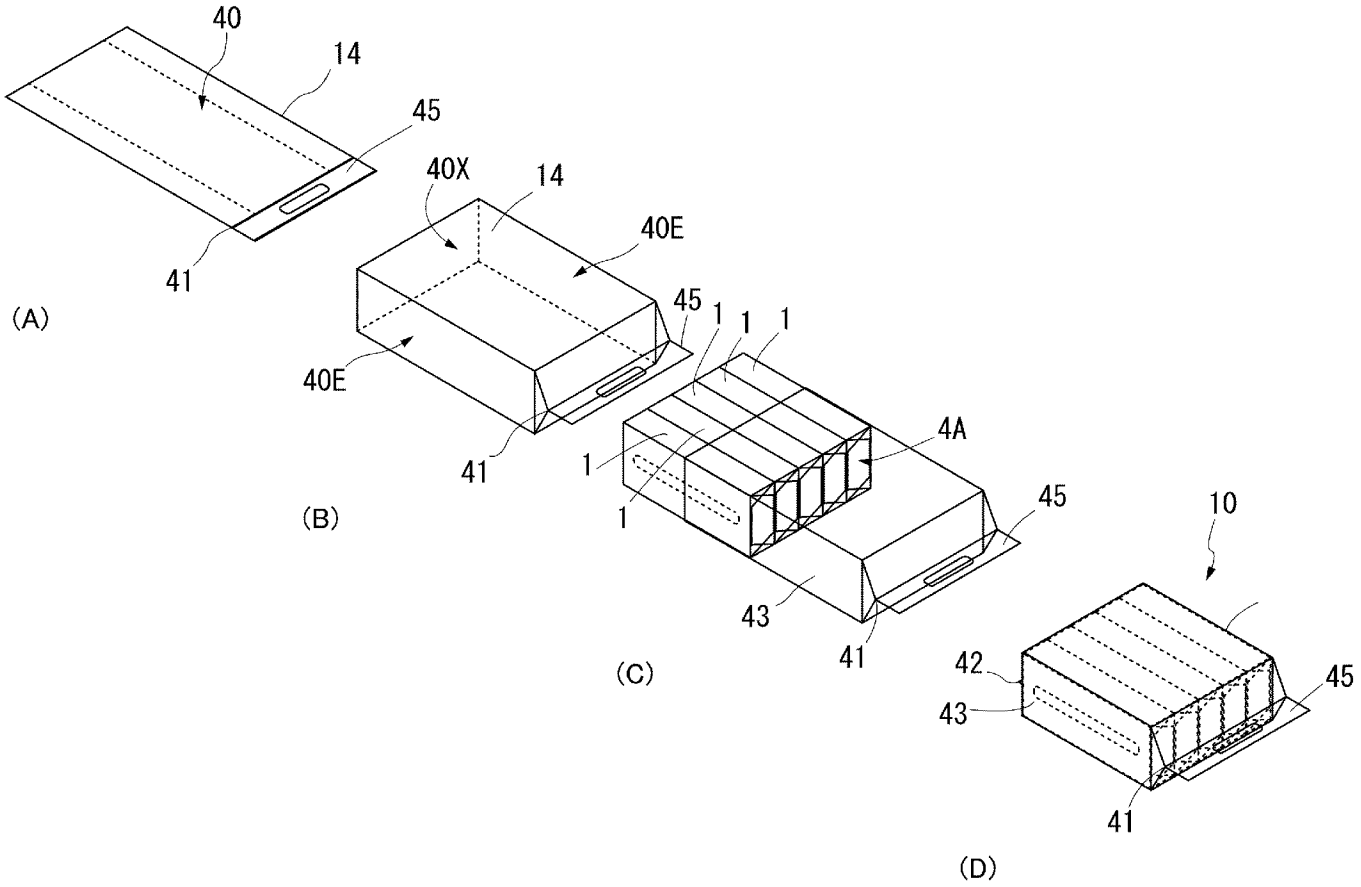
FIG. 5 illustrates perspective views for explaining an example of the production method and the structure of a film-packaged tissue product collective pack according to the present invention.

The collective pack employing the gusset-packaging is generally manufactured by, as shown particularly in FIGS. 4 and 5, heat-sealing the upper portion of the gusset-packaging tube 40, which has been flattened by folding side faces 40E, 40E of a cylindrical gusset-packaging film inwards of the bag, to seal the opening on the upper side to form an upper sealed portion 41 and the handle 45, opening the lower opening 40X of the gusset-packaging bag precursor sealed only on the upper side, and placing inside thereof a collection of film-packaged tissue products 1, which are the articles to be wrapped, and sealing the lower portion by suitable sealing means, such as heat sealing, to form a lower sealed portion 42. In this regard, however, the collective pack 10 according to the present invention may alternatively be manufactured by other processes, such as, though not shown, by heat-sealing the lower portion of the flattened gusset-packaging tube to first seal the opening on the lower side, and then opening the upper opening of the gusset-packaging packaging bag precursor sealed only on the lower side, and placing inside thereof a collection of film-packaged tissue products, which are the articles to be wrapped; or by unfolding the flattened gusset-packaging tube to open the upper and lower openings, and placing inside thereof a collection of the film-packaged tissue products, which are the articles to be wrapped, through either of the openings. Such other processes of manufacture also provides the advantages.

The process for manufacturing the collective pack according to the present invention is further discussed. For placing the film-packaged tissue products 1 through the opening 40X of the gusset-packaging bag precursor, a plurality of the film-packaged tissue products 1 are arranged in an approximate hexahedron such that the end faces 4A are flush with each other and the longitudinal lateral faces 4B are flush with each other, to form a collection of the film-packaged tissue products. Simultaneously with or later than the formation of the collection, the flattened gusset-packaging tube is unfolded by separating the front face 46 and the back face 46 of the gusset-packaging tube as discussed above, to form a gusset-packaging bag precursor having the openings 40X and a space inside for accommodating the collection, which is the article to be wrapped.

Then, the collection is forced into the accommodation space from its end face side or the upper side, the unsealed upper or lower side is heat-sealed to form a collective pack 10. FIG. 5 illustrates an embodiment in which the collection is inserted from its end face 4A side. As discussed above, the heat-sealing may be performed either by sealing only one of the upper and lower sides before inserting the collection, or by heat-sealing the upper and lower sides simultaneously or separately after inserting the collection. Further, it is preferred that, when the collection is to be inserted from its end face 4A side as in the illustrated embodiment, a pressing step may be performed upon insertion, in which the collection is pressed from the sides of the aligned upper and lower faces to bind up the collection inside with the exterior film 14 so that the film-packaged tissue products do not fall apart in the collective pack.

The series of steps up to the formation of a collective pack from a gusset-packaging tube is carried out serially within a short time, so that it is important that blocking does not occur in the step of unfolding the gusset-packaging tube 40 or the precursor thereof so as to separate the face to be the front face 46 from the face to be the back face 46. Blocking means excessive sticking between film layers, and once occurred, disturbs continuous formation of the openings 40X and the accommodation space. In the heat-sealing step for sealing the openings of the gusset-packaging tube in the gusset-packaging for the collective pack 10, the heat-sealing temperature is about 120 to 140° C., and the duration of the heat-sealing is about 1.5 to 3.0 seconds. Upon forcing the collection of the film-packaged tissue products 1 through an opening into the accommodation space, the film-packaged tissue products are rubbed against the inner surface of the gusset-packaging tube 40, and thus care should be taken to avoid excessive friction and damage of the gusset-packaging tube. Note that the packaging film 14 forming the gusset-packaging bag is formed of a packaging material for a film-packaged tissue product collective pack according to the present invention. Accordingly, the gusset-packaging tube 40, the gusset-packaging bag precursor, and the film as a material of these, are formed of a packaging material for a film-packaged tissue product collective pack according to the present invention.

In the collective pack 10 according to the present invention, the exterior film 14 thereof and the packaging material for the film-packaged tissue product collective pack are unique, in order to solve the problems arising from the conditions peculiar to the manufacturing process discussed above or conditions in use. Note that the exterior film 14 is to be discussed hereinbelow, and the discussion is also applicable to the packaging material for a film-packaged tissue product collective pack.

The exterior film 14 according to the present invention is a biomass film containing a 10 mass % or less biomass raw material. Though a biomass film containing a biomass raw material is hard to have the same physical properties as those of a petroleum-derived film free of a biomass raw material, a biomass film with a content of a biomass raw material not exceeding 10 mass % may sufficiently be used as the exterior film 14 of the collective pack 10. This also achieves reduction of environmental burden through the use of the biomass raw materials. The exterior film 14 is particularly preferably a biomass film containing a biomass raw material derived from plant materials, such as sugar canes, potatoes (starch), or corns, which is still more advantageous in reducing environmental burden.

The exterior film 14 is preferably a linear low-density polyethylene film (LLDPE) containing 3 to 10 mass % plant-derived polyethylene, which is a biomass raw material. The density is preferably 0.910 to 0940 g/cm$^3$. With the linear low-density polyethylene film containing 3 to 10 mass % plant-derived polyethylene, a melting point of 110 to 120° C., which is suitable for gusset-packaging, may easily be imparted, and the cost may be lowered. Alternatively, the exterior film may be a polypropylene film containing a biomass-based polyethylene, though the plant-derived polyethylene is more readily available. Further, the exterior film may be a single layer film of a polyethylene terephthalate film, a nylon film, a polyvinylidene chloride film, or an ethylene-vinyl alcohol copolymer; a suitably laminated film containing any of these films; or a gas barrier film obtained by subjecting any of these films to surface treatment, such as aluminum deposition.

On the other hand, the exterior film 14 has a degree of blocking of 120 mN or lower. Specifically, the degree of blocking refers to the degree of blocking of the inner surface of the exterior film 14, i.e., between the inner surface of the front face 46 and the inner surface of the back face 46. With the degree of blocking of the exterior film 14 being 120 mN or lower, the problems expected in the manufacture by gusset-packaging may be solved. The lower limit of the degree of blocking is not limited and may be over 0 mN, and a degree of blocking of about 100 mN provides sufficient handleability.

In the gusset-packaging tube according to the present invention, the layers are in pressure contact with each other as the tube is in the form of a product rolled under a certain tension. Further, the gusset-packaging tube may be placed in an environment of about 50° C. during manufacture. The degree of blocking according to the present invention defines the force required for separating the film layers which were pressed into contact at an ambient temperature of 50° C. at humidity as it is.

Figure 6:
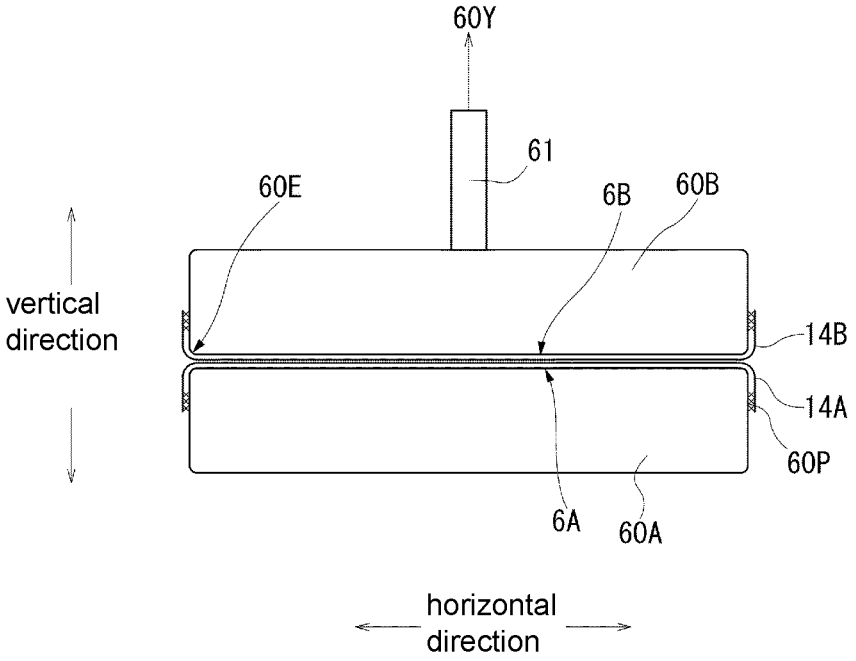
FIG. 6 illustrates how the degree of blocking is determined according to the present invention.
Figure 7:
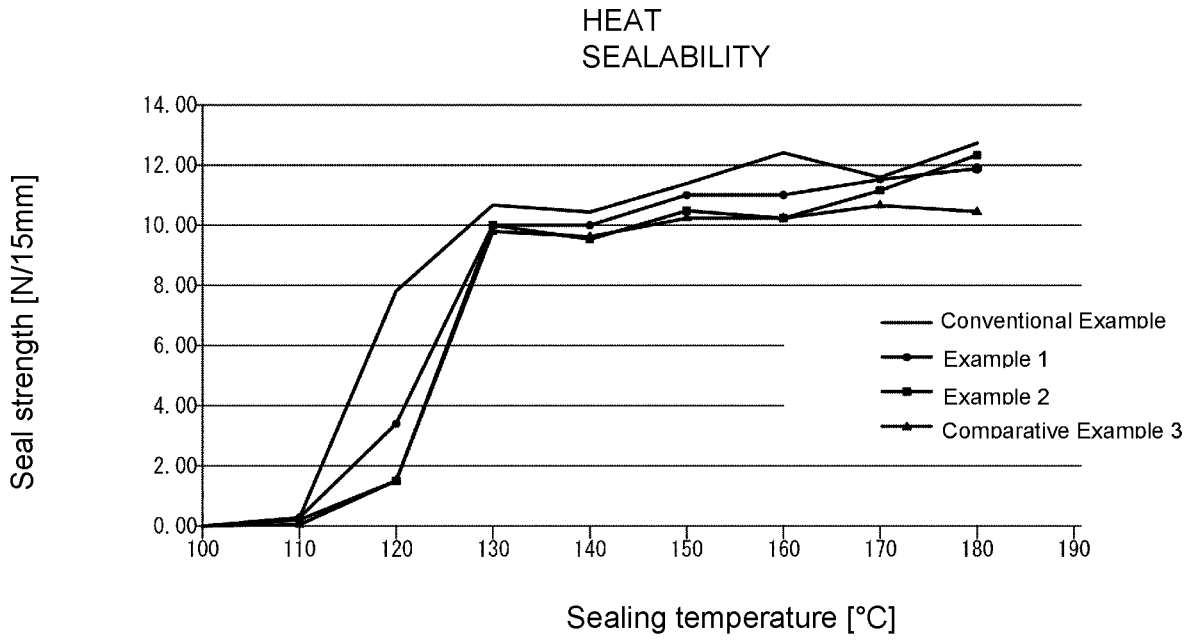
FIG. 7 is a graph illustrating the heat-sealing property according to the present invention.

The degree of blocking may be measured as discussed with reference to FIG. 6 below. First, on a flat plate 60A having a flat surface 6A of 100 mm×100 mm, a specimen 14A to be measured of generally 135 mm×135 mm, which is larger than the flat surface 6A (100 mm×100 mm), is placed, and fixed thereto so that the specimen 14A is integrally attached to the flat surface 6A. This fixing may be achieved by adhering the specimen 14A to the areas 60P of the flat plate 60A other than the flat surface thereof by means of a pressure-sensitive adhesive tape or an adhesive agent. Next, on the specimen 14A placed on the flat surface, a specimen 14B to be measured of the same size as the specimen 14A is placed, and then a flat weight plate 60B having a bottom surface 6B of 100 mm×100 mm is placed thereon and fixed thereto so that the specimen 14B is integrally attached to the bottom surface of the flat weight plate 60B. The mass of the flat weight plate 60B is 20 to 25 kg to provide sufficient pressure simulating the pressure contact in a rolled state. This fixing may also be achieved by adhering the specimen 14B to the areas of the flat weight plate 60B other than the bottom surface thereof by means of a pressure-sensitive adhesive tape or an adhesive agent. The specimen 14A and the specimen 14B held between the flat plate 60A and the flat weight plate 60B are left to stand at 50° C. for three to four days, which are sufficiently long period of time. Next, with the flat surface 6A and the bottom surface 6B kept in horizontal positions, the flat weight plate 60B, to which the specimen 14B is fixed, is taken away from the flat surface 6A, to which the specimen 14A is fixed, to thereby separate the specimen 14A from the specimen 14B. The force required for the separation is measured. The force required for the separation is applied at a rate of about 0.05 g per second. During the separation, the force is applied evenly so as not to be applied to a particular area between the bottom surface 6B and the flat surface 6A. For example, as in the illustrated example, the flat weight plate 60B is vertically lifted via a jig for separation attached to the center (center of gravity) of the flat weight plate 60B. It is preferred to bevel the edges 60E of the flat surface 6A and the bottom surface 6B of the flat plate 60A and the flat weight plate 60B, respectively, which may keep the separating force from being applied to a particular area. As discussed above, the gusset-packaging tube is in the form of a product rolled under a certain tension, and may be placed in an environment of about 50° C. during manufacture. Though the pressure between the layers or the conditions of storage in the rolled state may differ precisely, the present inventors have found out that the measurement under the above-discussed conditions may provide an index for unfolding the gusset-packaging tube in gusset-packaging.

The present inventors have further found out that the degree of blocking is significantly affected by the proportion of the biomass raw materials, as will be demonstrated in the Examples. In particular, the present inventors have revealed that the degree of blocking is not proportional to the proportion of the biomass raw materials over 10% and varies widely, which leads to the assumption that at a proportion of the biomass raw materials over 10%, the degree of blocking is unstable depending on the homogeneity of the raw materials. At a proportion of the biomass raw materials of 10% or less, a degree of blocking of 120 mN or lower, at which the gusset-packaging tube is stable enough to be unfolded, may extremely easily be achievable.

On the other hand, the exterior film 14 has a tensile elastic modulus in the transverse direction (TD) of 380 to 460 MPa. The tensile elastic modulus in the TD within this range is suitable for the exterior film to package the film-packaged products by gusset-packaging, and may enhance the tightness of the film packaging. In gusset-packaging, in particular, since the individual collective packs 10 are manufactured using successive gusset-packaging tubes, the vertical direction of the packs is aligned to the machine direction (MD), and the gusset-to-gusset direction (between lateral faces) is aligned to the transverse direction (TD). Accordingly, in particular, when a collection of the film-packaged tissue products 1 is packaged with the exterior film 14 with the end faces 4A oriented toward the upper and lower sides as shown in FIG. 1 and, in particular, when the film-packaged tissue products 1 are pressed from the upper and lower sides, the exterior film 14 is expanded from inside toward outside in the TD. With the tensile elastic modulus within the above-mentioned range, a preferred shape of the collective packs 10 may sufficiently be maintained.

Further, the exterior film 14 preferably has a tensile elastic modulus in the MD of 260 to 310 MPa. When the collective pack 10 is held at the handle 45, the exterior film 14 is expanded in the vertical direction, i.e., in the MD. With the tensile elastic modulus in the MD within the above-mentioned range, the exterior film 14 commonly enclosing about three to twelve film-packaged tissue products 1, when held and carried at the handle 45, will not be deformed excessively.

Note that the tensile elastic moduli in the TD and the MD discussed above are determined in accordance with JIS K 7127 "Determination of tensile properties—Part 3: Test conditions for films and sheets".

On the other hand, the exterior film has a haze value of preferably 15.0% or lower, more preferably 12.0% or lower. With a haze value of 12.0% or lower, a sufficiently transparent film may be provided to facilitate visual observation of the enclosures with cleanliness. Here, the present inventors have found out that the haze value increases with the increase in proportion of the biomass raw materials, but the above-mentioned haze value may be imparted when the proportion of the biomass raw materials is 10% or lower. Note that the haze value (HAZE) is determined in accordance with JIS K 7136 "Plastics—Determination of haze for transparent materials".

On the other hand, the exterior film 14 has a coefficient of dynamic friction on its inner surface of preferably 0.05 to 0.20. With the coefficient of dynamic friction within this range, the gusset-packaging tube 40 may be unfolded smoothly, and excessive friction is not generated in enclosing the collection inside the gusset-packaging tube, to thereby achieve smooth enclosing. Note that the coefficient of dynamic friction is determined in accordance with JIS K 7125 "Plastics—Films and sheeting—Determination of the coefficients of friction".

Further, the exterior film 14 has an electrostatic potential of preferably 0.35 kV or lower. With the electrostatic potential within this range, the exterior film may be treated in the same way as an exterior film free of biomass raw materials. The electrostatic potential may be adjusted using an anti-static agent. Note that the electrostatic potential is determined in accordance with JIS L 1094 "Testing methods for electrostatic propensity of woven and knitted fabrics".

Further, the exterior film 14 has a tear resistance in the TD of preferably 10.0 N or higher. In particular, in a collective pack 10 containing the film-packaged tissue products 1 in individual overlap-wrapping with the end faces 4A oriented in the upper and lower sides, during insertion of the collection of the tissue products into the accommodation space, four relatively sharp vertices 4*t* of the end faces may be rubbed against the exterior film 14. Further, with the exterior film 14 having a handle 45 on the upper side of the pack, when held at the handle 45, or when then placed with its bottom face down, the gusset-packaging bag formed of the exterior film 14 is stretched in the vertical direction, where the enclosed film-packaged tissue products 1 may be rubbed against the exterior film 14. In this case, the four vertices 4*t* of the end faces may particularly be rubbed against the exterior film 14. With a tear resistance of 10.0 N or higher, the exterior film 14 is significantly less prone to tear even when rubbed by the four vertices 4*t* of the end faces. Note that the tear resistance is determined in accordance with JIS K 7128-2 "Plastics—Film and sheeting—Determination of tear resistance—Part 2: Elmendorf method".

Further, with regard to the thickness and softness of the exterior film 14 constituting the gusset-packaging bag, in view of flexibility, heat-sealability in packaging, as well as tearability allowing easy opening, wear resistance against the enclosed film-packaged tissue products 1, in particular their four vertices 4*t* of the end faces, and flexibility for avoiding excess load on fingers when the collective pack is carried with the fingers placed through the finger hole provided in the handle, the thickness is preferably 10 to 65 μm as determined in accordance with JIS P 8118 (1998), and the softness of 5.0 to 50.0 cN as determined by the Handle-O-Meter method in accordance with Method E in JIS L 1096 (2010).

The film-packaged tissue product collective pack 10 according to the present invention, which has the exterior film 14 made of the packaging material for a film-packaged tissue product collective pack as discussed above, may be handled in the same way as the conventional collective packs, and may be manufactured with the same operational efficiency as the conventional collective packs, while it aims to reduce environmental burden through the use of biomass raw materials. Further discussion is to be made below with reference to the Examples.

EXAMPLES

Physical properties of packaging materials for a film-packaged tissue product collective pack, which are the exterior films according to the present invention (Examples 1 and 2), exterior films with increased proportion of the biomass raw materials (Comparative Examples 1 to 3), and an exterior film made solely of petroleum-derived materials without a biomass raw material (Conventional Example 1), were measured for suitability/unsuitability for an exterior film for film-packaged tissue product collective pack. Here, the biomass raw material was plant-derived biomass polyethylene, and the exterior film was a polyethylene film in all of the Examples.

The measured values of the physical properties shown in Table 1 indicate what have been discussed in the detailed description of the invention above. The tensile strength, the tensile elongation, and the load at 2% elongation in Table 1 were determined in accordance with JIS K 7127 "Determination of tensile properties—Part 3: Test conditions for films and sheets".

TABLE 1

| Item | | Unit | Conventional Product 1 | Ex. 1 | Ex. 2 | Comp. Ex. 1 | Comp. Ex. 2 | Comp. Ex. 3 |
|---|---|---|---|---|---|---|---|---|
| Biomass content | | | 0% | 5% | 10% | 15% | 20% | 25% |
| Basis weight | | g/m$^2$ | 33.2 | 32.5 | 33.6 | 33.5 | 33.6 | 33.5 |
| Thickness | | μm | 36.0 | 35.5 | 36.6 | 36.4 | 36.5 | 36.3 |
| Tensile strength | MD | N/cm | 15.6 | 15.9 | 15.6 | 15.4 | 16.9 | 15.9 |
| | TD | | 15.5 | 15.8 | 15.6 | 14.6 | 14.1 | 15.0 |
| Tensile elongation | MD | % | 665 | 640 | 680 | 595 | 580 | 665 |
| | TD | | 815 | 810 | 840 | 820 | 775 | 865 |
| Load at 2% elongation | MD | N/20 mm | 2.89 | 3.16 | 3.26 | 3.51 | 3.58 | 2.83 |
| | TD | | 4.05 | 4.13 | 4.31 | 4.51 | 4.43 | 3.89 |
| Tensile elastic modulus | MD | MPa | 272 | 306 | 309 | 282 | 304 | 263 |
| | TD | | 386 | 459 | 432 | 388 | 400 | 391 |
| Tear resistance | MD | N | 1.0 | 1.2 | 1.1 | 1.0 | 0.9 | 1.1 |
| | TD | | 11.5 | 12.2 | 12.4 | 9.2 | 9.7 | 11.9 |
| Coefficient of dynamic friction | | — | 0.11 | 0.11 | 0.10 | 0.12 | 0.12 | 0.12 |
| Haze | | % | 11.10 | 10.35 | 10.83 | 10.84 | 10.97 | 12.83 |
| Degree of blocking | | mN | 105 | 112 | 99 | 491 | 545 | 235 |
| Electrostatic Potential | | kV | 0.29 | 0.30 | 0.32 | 0.33 | 0.34 | 0.34 |
| Sealing strength with respect to temperature gradient | | | | | | | | |
| Treated face in MD | T5 | N | 10.40 | 10.00 | 9.50 | 9.50 | 9.60 | 9.60 |
| | T6 | | 10.70 | 10.00 | 10.00 | 10.00 | 9.90 | 9.90 |
| | T7 | | 7.90 | 3.40 | 1.50 | 1.50 | 1.50 | 1.50 |
| | T8 | | 0.30 | 0.30 | 0.20 | 0.20 | 0.20 | 0.20 |

* Sealing temperature: T5: 140° C., T6: 130° C., T7: 120° C., T8: 110° C.

The Table shows that, in Examples 1 and 2, in which the proportions of the biomass raw material were 5% and 10%, respectively, the degrees of blocking were comparable to that of petroleum-derived polyethylene film in Conventional Example 1, whereas in Comparative Example 1, in which the proportion of the biomass raw material was 15%, the degree of blocking was as extremely high as 491 mN. Further, in Comparative Example 3, in which the proportion of the biomass raw material was 25%, the degree of blocking was lower than that in Comparative Example 1, though the proportion of biomass raw material was higher than that in Comparative Example 1.

Further, with regard to the physical properties pertaining mainly to the elongation of films, such as tensile strength, tensile elongation, load at 2% elongation, tensile elastic modulus, and tear resistance, the films containing up to 10% biomass raw material exhibited values comparable to those of the petroleum-derived film containing 0% biomass raw material in Conventional Example 1, or exhibited proportional changes, whereas the films containing over 15% biomass raw material exhibited no proportional changes and the values showed considerable variations.

Further, the haze value and the electrostatic potential tend to be worse in proportion to the elevation in the proportion of the biomass content. With regard to heat-sealability, sealing strengths in Conventional Example 1, Examples 1 and 2, and Comparative Example 3 are indicated in the Table under the title of sealing strength with respect to temperature gradient, and also shown graphically in FIG. 7. It is shown that heat sealing may be made in the temperature range of 120 to 140 degrees in Examples. Further, the tendency of deteriorated heat sealability is observed with the increase in proportion of the biomass raw material.

The collective pack according to the present invention, of which packaging material contains 10% or less biomass raw material and has a degree of blocking of 120 mN or lower, may be handled in the same way as, and may be manufactured with the same operational efficiency as the conventional collective packs, while reduction of environmental burden may be aimed through the use of biomass raw materials.

DESCRIPTION OF REFERENCE NUMERALS

1 film-packaged tissue product
3 bundle of tissues
4 packaging film
4A end face
4B longitudinal lateral face
4C top face
10 film-packaged tissue product collective pack
14 exterior film
4*t* four vertices of top face
4X overlapped area of packaging film
4Y extension of packaging film
4Z cylinder opening of packaging film
5 perforated line for tear-opening
40 gusset-packaging tube
40E side face of gusset-packaging film in the form of gusset-packaging tube
40X opening in lower side of gusset-packaging bag precursor
41 upper sealed portion
42 lower sealed portion
43 gusset
44 upper side
45 handle
46 front face, back face
47 finger hole

The invention claimed is:

1. A film-packaged tissue product collective pack comprising:

a plurality of film-packaged tissue products; and an exterior film gusset-packaging the plurality of film-packaged tissue products to form a collective pack having a handle on its upper side, wherein the exterior film is prepared from a mixture of linear low density petroleum-derived polyethylene and 3 to 10 mass % plant-derived polyethylene, wherein the exterior film has a degree of blocking of 120 mN or lower, and wherein the exterior film has a tensile elastic modulus in a transverse direction (TD) of 380 to 460 MPa.

2. The film-packaged tissue product collective pack according to claim 1, wherein the exterior film has a haze value of 12% or lower.

3. The film-packaged tissue product collective pack according to claim 1, wherein the electrostatic potential of the exterior film is 0.35 kV or lower.

4. The film-packaged tissue product collective pack according to claim 1, wherein the melting point of the exterior film is 110 to 120° C.

5. The film-packaged tissue product collective pack according to claim 1, wherein the density of the exterior film is 0.91 to 0.94 g/cm$^3$.

6. The film-packaged tissue product collective pack according to claim 5, wherein the thickness of the exterior film is about 10-65 μm.

7. The film-packaged tissue product collective pack according to claim 6, wherein the basis weight of the exterior film is about 32.5-33.6 g/m$^2$.

8. A packaging material for a film-packaged tissue product collective pack for packaging by gusset-packaging a plurality of film-packaged tissue products into a collective pack having a handle on its upper side, wherein the packaging material is a film prepared from a mixture of a linear-low density petroleum-derived polyethylene and 3 to 10 mass % plant-derived polyethylene, wherein the film has a degree of blocking of 120 mN or lower, and wherein the film has a tensile elastic modulus in a transverse direction (TD) of 380 to 460 MPa.

9. The packaging material for a film-packaged tissue product collective pack according to claim 8, wherein the packaging material has a haze value of 12% or lower.

10. The packaging material for a film-packaged tissue product collective pack according to claim 8, wherein the electrostatic potential of the packaging material is 0.35 kV or lower.

11. The packaging material for a film-packaged tissue product collective pack according to claim 8, wherein the melting point of the packaging material is 110 to 120° C.

12. The packaging material of according to claim 8, wherein the density of the packaging material is 0.91 to 0.94 g/cm$^3$.

13. The packaging material for a film-packaged tissue product collective pack according to claim 12, wherein the thickness of the packaging material is about 10-65 μm.

14. The packaging material for the film-packaged tissue product collective pack according to claim 13, wherein the basis weight of the packaging material is about 32.5-33.6 g/m$^2$.

* * * * *